United States Patent [19]

Seidenberg et al.

[11] Patent Number: 4,883,116

[45] Date of Patent: Nov. 28, 1989

[54] CERAMIC HEAT PIPE WICK

[75] Inventors: Benjamin Seidenberg, Baltimore; Theodore D. Swanson, Columbia, both of Md.

[73] Assignee: The United States of America as represented by the Administrator of the National Aeronautics and Space Administration, Washington, D.C.

[21] Appl. No.: 304,147

[22] Filed: Jan. 31, 1989

[51] Int. Cl.[4] ..... F28D 15/02

[52] U.S. Cl. ..... 165/104.26; 165/905; 165/41; 122/366

[58] Field of Search ..... 165/104.26, 104.33, 165/905, 41; 122/366

[56] References Cited

U.S. PATENT DOCUMENTS

| | | | |
|---|---|---|---|
| 3,840,069 | 10/1974 | Fischer et al. . | |
| 3,901,311 | 8/1975 | Kosson et al. | 165/104.26 |
| 3,954,927 | 5/1976 | Duling et al. . | |
| 4,274,479 | 6/1981 | Eastman | 165/104.26 |
| 4,414,961 | 11/1983 | Luebbe | 165/104.26 |
| 4,765,396 | 8/1988 | Seidenberg | 165/104.26 |

FOREIGN PATENT DOCUMENTS

| | | | |
|---|---|---|---|
| 759832 | 9/1980 | U.S.S.R. | 165/104.26 |
| 482711 | 4/1938 | United Kingdom | 165/907 |

*Primary Examiner*—Albert W. Davis, Jr.
*Attorney, Agent, or Firm*—R. Dennis Marchant; John R. Manning; Ronald F. Sandler

[57] ABSTRACT

A wick for use in a capillary loop pump heat pipe. The wick material is an essentially uniformly porous, permeable, open-cell, silicon dioxide/aluminum oxide inorganic ceramic foam having a silica fiber to alumina fiber ratio, by weight, of about 78 to 22, respectively, a density of 6 lbs/ft$^3$, and an average pore size of less than 5 microns. A representative material having these characteristics is Lockheed Missiles and Space Company, Inc. HTP 6-22. This material is fully compatible with the FREONs and anhydrous ammonia and allows for the use of these very efficient working fluids, and others, in capillary loops.

18 Claims, 1 Drawing Sheet

CERAMIC HEAT PIPE WICK

ORIGIN OF THE INVENTION

The invention described herein was made by employees of the U.S. Government and may be manufactured and used by or for the government of the United States of America for governmental purposes without the payment of any royalties thereon or therefor.

TECHNICAL FIELD

This invention generally relates to the art of heat exchange, and more particularly to a wick suitable for use within a capillary pump loop heat pipe system.

BACKGROUND ART

There are situations in which heat must be transferred from a locale of heat generation to a locale of heat rejection under circumstances in which insufficient energy exists to operate a conventional heat transfer system. This occurs in spacecraft environments where large amounts of heat must be rejected to ensure the proper operation of the spacecraft and its systems. Locales of heat generation in a spacecraft include the onboard electronics and exterior surfaces facing the sun, while locales of heat rejection include exterior surfaces not facing the sun and areas requiring heat, such as a crew's cabin.

One system that transfers heat efficiently with little or no external power requirements is the capillary pump loop (CPL) heat pipe system. A CPL heat pipe system is a two-phase heat transfer system which utilizes a vaporizable liquid. Ammonia and the FREONs have been found to be among the best working liquids. Heat is absorbed by the liquid when its phase changes from a liquid state to a vapor state upon evaporation, and heat is released when condensation of the vapor occurs. The CPL heat pipe system includes a heat pipe containing a capillary structure, such as a porous wick, and a continuous loop. The continuous loop provides a vapor phase flow zone, a condenser zone, and a liquid return zone.

The key factor affecting the efficiency of the heat transfer by a CPL heat pipe system is the selection of the working fluid. In turn, the wick employed in the loop must be compatible with the working fluid. Besides being compatible with the working fluid, good wicks must have uniform porosity and good machinability. Compatibility must be both chemical and physical. The wick must not swell, shrink or shed particles. Uniform porosity is required to achieve proper pumping action at the outside surface of the wick. The pressure head generated by the capillary pump is an inverse function of the pore size. Larger, non-uniform pores can act to greatly reduce the effective pumping capability. Hence, the pore size of the wick should be small because, as the pore size decreases, the capillary pressure, i.e., fluid static height or pumping action which the wick can generate, increases, and the amount of heat which can be transferred also increases. However, as the pore size decreases, the permeability of the wick to radial and longitudinal fluid flow also tends to decrease. Also, the tendency for the wick to clog may increase. Thus, for maximum heat transfer efficiency, a wick material offering the optimum small pore size and other physical properties, e.g. wetability, is preferable. Other factors are also to be considered in selecting a wick material. The wick material should be resistant to chemical attack by the working fluid, and it should not contaminate the fluid chemically or physically generate particulates. Chemical contamination of the fluid will change its evaporation characteristics, and it may produce gas bubbles which will accumulate and enlarge in the condenser zone and eventually block fluid flow. Particulate contamination will also cause blockage. Furthermore, it is desirable for the wick material to be resistant to degradation b heat, and to be cold resistant for use in low temperature heat transfer applications. Generally, it is desirable for the wick to operate across extreme temperature limits, from the very hot to the very cold. The wick material should be easy to machine so that it can be made to conform to a heat pipe having any geometrical shape, and non-brittle so as to be vibration resistant. Lastly, it should be easily integrated with the remainder of its CPL heat pipe system.

Heat pipe wicks have been heretofore fabricated of various types of materials in an attempt to achieve ammonia and FREON compatibility. One type of material is a brillo-like metal wire mesh, but no capillary action was achieved. Examples of metals used are copper, stainless steel, and aluminum. Wire mesh wicks are made by knitting, felting round wire, and by stacking corrugated flat ribbon wire. They generally have pores of nonuniform size, which results in the poor and uneven generation of capillary pressure along the length of the wick, and they are subject to chemical attack by corrosive fluids. They are also very friable, which results in the fluid being contaminated with particulates, and they can chemically contaminate the fluid.

Another type of wick material is a sintered metal wick. Examples of metals used in sintered metal wicks are copper, oxidized stainless steel, molybdenum, tungsten, and nickel. These wicks are generally constructed in tubular or flat sheet form by heating metal powder or metal slurries on a removable, cylindrical or flat mold mandrel. Wicks produced by this method are usually friable, and have pores of uneven size. They are also subject to chemical attack by corrosive fluids, and they can chemically react with chemically active fluids to contaminate the fluids. They may also be subject to cracking.

Prior art heat pipe wicks have also been constructed of particulate sintered ceramics. The prior art sintered ceramic wicks, however, are extremely friable and they exhibit poor capillary performance. Additionally, they are physically degraded in use and they are difficult to produce in tubular form.

Two other types of wick materials are cloth wicks and glass fiber wicks. Cloth wicks are generally formed by stacking disks of cloth cut out of a sheet to form a cylinder. Cloth wicks are subject to attack by corrosive fluids, and they produce particulates and fibers in use. Glass fibers, on the other hand, are generally not subject to attack by corrosive fluids. However, they are very brittle, hard to form into a desired shape, and they cannot be greatly stressed or strained in use without breaking.

One particular material which has been used as a heat pipe wick is a felted ceramic comprised of 50% $SiO_2$ and 50% $Al_2O_3$. Rings of this material are cut out of a sheet and stacked together to form a cylinder. This material is extremely friable, and it exhibits poor capillary performance. It also produces particulates during use and is subject to chemical attack by corrosive fluids.

Of all the known CPL wicks, including those noted above, none except a high molecular weight polymeric wick with a somewhat limited temperature range have been found to be suitable for use with anhydrous ammonia and the FREONs, such as FREON 11, which are the most effective refrigerants known.

STATEMENT OF INVENTION

Accordingly, it is an object of this invention to provide a wick which is generally suitable for use in CPL heat pipe exchange systems.

Another object of this invention is to provide a wick which exhibits a superior temperature range characteristic that allows operation across temperature extremes, from the very cold to the very hot.

A further object of this invention is to provide a wick which will not produce either chemical or particulate contaminants during use.

A still further object of this invention is to provide a wick which is not degraded in use.

Still another object of this invention is to provide a wick suitable for use in CPL heat pipe systems employing anhydrous ammonia or FREONs as the working fluid.

Yet another object of this invention is to provide a wick constructed from material which is easily machined and easily integrated into a CPL heat pipe system.

Still another object of this invention is to provide a very efficient wick for use in a CPL heat pipe system.

A still further object of this invention is to provide a CPL heat pipe system employing a wick that is physically and chemically compatible with all known common working fluids.

According to the invention, the foregoing and other objects are attained by providing a wick comprised of a uniformly porous, permeable, ceramic material in the form of an open-cell, fibrous, inorganic ceramic foam.

DETAIL DESCRIPTION

Figure 1:
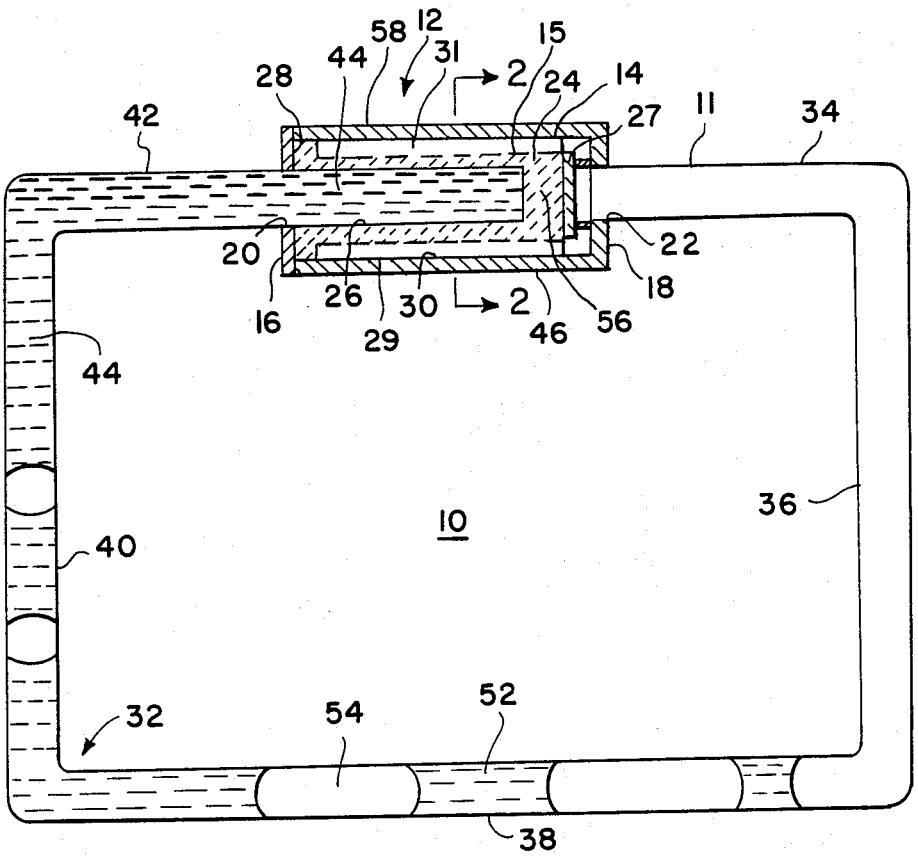
FIG. 1 is a full cut-away view of a capillary pump loop system taken through a plane which includes the central longitudinal axis of the heat pipe and the central longitudinal axis of each section of the continuous loop.
Figure 2:
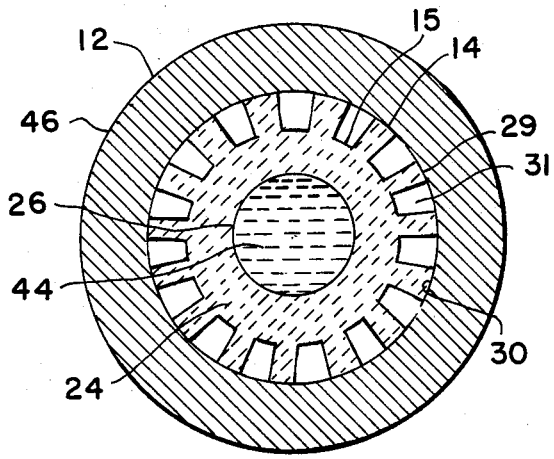
FIG. 2 is a section of the heat pipe and wick taken along line 2—2 of FIG. 1.

Referring now to the drawings wherein like reference numerals and characters designate identical or corresponding parts throughout the different views, and more particularly to FIG. 1, wherein a capillary pump loop heat pipe system 10 is illustrated. The capillary pump loop heat pipe system 10 includes a hollow tube 11 which extends around the entire loop, has a central longitudinal axis, not illustrated, and is preferably cylindrical in shape. FIG. 2 illustrates, in cross-section, the evaporator 12 of the capillary pump loop heat pipe system 10, which is designed to contain a wick abutting its inner surface. The evaporator 12 is bounded at its ends by walls 16 and 18 which may be either an integral part of the pipe or secured thereto in a conventional way. Wall 16 has a round, centrally located port 20 for liquid entry, and wall 18 has a round, centrally located port 22 for vapor outlet. Both ports typically have the same diameter. Evaporator 12, as well as walls 16 and 18, may be constructed from any suitable metallic material, such as aluminum or stainless steel.

Evaporator 12 is centrally packed with a porous, elongated wick 24. Wick 24 has a central longitudinal axis, not illustrated, which is coextensive with the central longitudinal axis of the evaporator 12, and a central bore 26 extending partially along the axis from an open end 28 of the wick. Although flat wicks can be used, in this embodiment wick 24 and bore 26 are in the preferred cylindrical shape, and the diameter of bore 26 is preferably equal to the diameter of port 20. Wick 24 has a closed end 56. Wick 24 preferably occupies almost the entire volume of the evaporator 12 and is placed within the evaporator so that its end 28 abuts, and is coextensive with, wall 16, and the wick outer surface 29 is in tight thermal contact with the inner surface 30 of the evaporator housing 58. Referring now to FIGS. 1 and 2, a series of fins 14 are formed by cutting grooves 15 into the outer surface 29 which, in turn, form a series of channels 31 longitudinally along the wick, and which extend almost the entire length of the wick, but short of port 20. It is important that these channels 31 do not extend to wall 16 in order to prevent leakage of the refrigerent 44, in liquid form, around the wick. The channels 31 vent evaporated refrigerent into port 22 which provides a vapor flow outlet. It should be noted that the evaporator housing 58 may be fabricated with axial grooves and the wick provided with a smooth outside surface. It is only important that there exist some type of channel for venting the vapor. Stand-off pedestal 27 is provided to ensure that the wick is separated from wall 18, thereby providing a vapor header.

A continuous loop of metallic tubing 32 is connected between ports 20 and 22. Loop 32 includes a segment 34 and another segment 36 which together form the vapor phase flow zone of system 10. The tubing also has a segment 38 which forms the condenser zone, and segments 40 and 42 which together form the liquid return zone of system 10. The tubing comprising loop 32 preferably is cylindrical and has an inside diameter which is equal to the diameter of ports 20 and 22. The tubing may be made of any suitable material, such as aluminum or stainless steel, and is preferably smooth walled. It should be noted that the metals which are employed must be compatible with whatever working fluids are used.

A vaporizable fluid 44 is initially present in the condenser and liquid return zones, as well as bore 26, in its liquid phase. The liquid phase of fluid 44 also saturates wick 24. Examples of fluids which may be used include anhydrous ammonia ($NH_3$) and the FREONS including, but not limited to, trichlorofluoromethane ($CCl_3F$), trichlorotrifluoroethane ($CCl_2FCClF_2$), and dichlorotetrafluoroethane ($CClF_2CClF_2$) Channels 31 contain the vapor phase of the fluid 44, which results from evaporation of the fluid from wick 24 at a vapor pressure corresponding to the saturation pressure of the fluid at the instantaneous temperature of system 10. Free flow of the liquid is blocked by closed end 56 of the wick.

Heat to be removed from a source of heat, not illustrated, such as spacecraft electronics, is directly applied to evaporator 12 by placing the evaporator adjacent to or in close proximity with the heat source. The exterior surface 46 of evaporator 12 will absorb the heat, which, in turn, will be transferred, by conduction, to the interior of the evaporator, thereby causing evaporation of the liquid. Evaporation of the liquid will mostly occur at the inside surface 30, illustrated in FIG. 2, of evaporator 12, which is closest to wick 24, because this surface provides the most direct heat transfer. Vapor bubbles, not illustrated, will form on the fins 14 and grooves 15 of wick 24 closest to surface 30, and they will migrate until vented into channel 31.

Capillary action in wick 24 provides the necessary pressure differential to initiate vapor flow from channels 31 into the vapor phase flow zone and, in turn, into the condenser zone. Capillary action in wick 24 also causes the liquid to be continually supplied to the fins 14 and grooves 15. The surface tension of the liquid at these surfaces prevents migration of the vapor bubbles into the wick structure. This, in turn, prevents the capillary action of wick 24 from being blocked, which may occur if a sufficient number of vapor bubbles enter the wick. It also helps to ensure that flow around the capillary pump loop heat pipe system 10 is unidirectional from port 22 to port 20.

The condenser zone of system 10 is at a lower temperature than that of the vapor phase flow zone, and this causes the vapor flow to begin to condense. Heat will be removed from the vapor as it condenses in the condenser zone. In a spacecraft, the condenser segment 38 may be placed in an area away from sources of heat or in an area which requires a heat source, such as a crew compartment. Flow in the condenser segment 38 initially consists of high-velocity vapor plus a liquid wall film which subsequently turns, as the vapor cools, into slugs of liquid 52 separated by bubbles of vapor 54. The slight pressure exerted by the flow of the vapor from the vapor phase flow zone, comprising segments 34 and 36, causes both the vapor and the condensate to flow back toward heat pipe 10 through the liquid return zone, comprising segments 40 and 42. The liquid return zone is subcooled to collapse any remaining vapor bubbles. In a spacecraft, this may be accomplished by placing segments 40 and 42 in an unheated area of the spacecraft which is not exposed to radiation from the sun.

The wick 24 preferably will have uniform porosity, small, interconnecting pores so that the wick can generate a large capillary pressure, high permeability to liquid flow, resistance to degradation by extremely high and low temperatures, and resistance to degradation by chemicals, including resistance to swelling. Again, the wick material should not chemically contaminate the fluid used in the capillary loop pump heat pipe system, and it should also not produce particulates. Lastly, it should be easy to machine so that it can be made to conform to a heat pipe having any shape. A material which has all of these physical and chemical characteristics is an essentially uniformly porous, permeable, open-cell, silicon dioxide/aluminum oxide inorganic sintered ceramic foam having a silica fiber to alumina fiber ratio, by weight, of about 78 to 22, respectively, a density of approximately 6 lbs/ft$^3$, and an average pore size of less than 5 microns. A representative material having these characteristics is Lockheed Missiles and Space Company, Inc. HTP 6 22. It should be emphasized that this material is fibrous and the foam binder is also an inorganic ceramic material. Several suitable inorganic binders are available. One possible inorganic binder is boric oxide, which would be up to 3% of the ceramic material by weight. Other binders may be employed that would be made especially compatible with specific working fluids that are used. For example, a binder could be employed which includes sodium or potassium silicates, i.e., a water-glass composition. The provision of an inorganic binder is significant because organic binders are often more susceptible to degradation and may result in clogging the wick and, moreover, the use of organic binders involves a significant risk of contamination to the working fluid. Additionally, resulting bubble formation restricts or may stop fluid flow entirely.

Very importantly, this material is resistant to degradation by cold temperatures down to about −195° C. and hot temperatures up to about 1500° C., is resistant to and compatible with concentrated alkalis such as anhydrous ammonia, $NH_3$, and to all known organic solvents as well as strong oxidizing acids. Also very importantly, this material is compatible with FREONs such as trichlorofluoromethane, $CCl_3F$, trichlorotrifluoroethane, $CCl_2$, and with dichlorotetrafluoroethane, $CClF_2CClF_2$. Most other known CPL wicks have not been compatible with these working fluids, which may be the best of all the refrigerants. This wick material is also compatible with other known refrigerants such as, but not limited to, water, water-salts, alcohols and oils derived from citrus. It is not fragile in any way, which makes it suitable for use in high vibration environments. While it does not possess a self-lubricating surface, it is nevertheless easy to machine and to insert and seal into heat pipes. Some prior art wicks, such as the ultra high molecular weight polyethelene wicks, have had a tendency to melt or deform when attempting to weld or solder the end-walls of the evaporator to make the loop both liquid and vapor tight. All of these factors contribute greatly to the ease of fabricating CPL's and heat pipes with this new wick material.

Obviously, numerous modifications and variations of the present invention are possible in the light of this disclosure. It is therefore to be understood that within the scope of the appended claims the invention may be practiced otherwise than as specifically described therein.

We claim:

1. A wick for inclusion in a capillary loop or heat pipe including a first surface means for contacting a working fluid in a liquid state in said loop, and a second surface means for evaporation of said liquid in said loop, said wick being comprised of a permeable, open-cell, fibrous ceramic foam material.

2. The wick of claim 1 wherein said wick generally has the shape of a hollowed cylinder with an open end for liquid entrance and a closed end to block liquid flow, said first surface means being the interior surface area of said cylinder and said second surface means being the exterior surface area of said cylinder.

3. The wick of claim 1 includes silicon dioxide and aluminum oxide fibers.

4. The wick of claim 1 wherein said ceramic material is substantially inorganic.

5. The wick of claim 4 wherein said ceramic material includes an inorganic binder.

6. The wick of claim 1 wherein said ceramic material is essentially uniformly porous with a pore size of less than 5 microns.

7. The wick of claim 1 wherein said ceramic material is a silicon dioxide/aluminum oxide inorganic ceramic foam having a silica fiber to alumina fiber ratio, by weight, of about 78 to 22, respectively.

8. The wick of claim 1 wherein said ceramic material has a density of about 6 lbs/ft$^3$.

9. The wick of claim 1 wherein said first surface has a plurality of spaced axial grooves formed therein.

10. A capillary loop, including an evaporator, in the form of a continuous loop, with a wick positioned within less than the entire portion of said capillary pump, which wick is comprised of a permeable, open-cell, fibrous ceramic foam material, said loop further including a working fluid, said working fluid being selected from the group consisting of anhydrous ammonia and the fluorinated hydrocarbons, said wick material being chemically and physically compatible with said working fluid.

11. The capillary loop of claim 10 wherein said fluorinated hydrocarbon is trichlorofluoromethane.

12. The capillary loop of claim 10 wherein said fluorinated hydrocarbon is tricholorotrifluoroethane.

13. The capillary loop of claim 10 wherein said fluorinated hydrocarbon is dichlorotetrafluoroethane.

14. The capillary loop of claim 10 wherein said wick material is inorganic.

15. The capillary loop of claim 10 wherein said wick material is essentially uniformly porous with a pore size of less than 5 microns.

16. The capillary loop of claim 10 wherein said wick material has a density of about 6 lbs/ft$^3$.

17. The capillary loop of claim 10 wherein said wick material is a silicon dioxide/aluminum oxide inorganic ceramic foam having a silica fiber to alumina fiber ratio, by weight, of about 78 to 22, respectively.

18. The capillary loop of claim 10 wherein said wick material includes silicon dioxide and aluminum oxide fibers.

* * * * *